US005964512A

United States Patent [19]

Borgen

[11] Patent Number: 5,964,512

[45] **Date of Patent: *Oct. 12, 1999**

[54] COOLED DISPLAY CASE

[75] Inventor: Arden L. Borgen, Des Moines, Iowa

[73] Assignee: Margaret Platt Borgen, Des Moines, Iowa

[ * ] Notice: This patent issued on a continued prosecution application filed under 37 CFR 1.53(d), and is subject to the twenty year patent term provisions of 35 U.S.C. 154(a)(2).

[21] Appl. No.: 08/971,530

[22] Filed: Nov. 17, 1997

Related U.S. Application Data

[63] Continuation of application No. 08/642,566, May 3, 1996, abandoned.

[51] Int. Cl.[6] ..... A47F 3/04

[52] U.S. Cl. ..... 312/116; 312/236; 62/246; 62/251; 62/256

[58] Field of Search ..... 312/114, 116, 312/126, 236; 62/246, 251, 256; 211/71, 73

[56] References Cited

U.S. PATENT DOCUMENTS

| | | | |
|---|---|---|---|
| 2,279,484 | 4/1942 | Munshower | 62/251 |
| 2,594,066 | 4/1952 | Pabst | 62/251 |
| 2,630,684 | 3/1953 | Strang | 62/251 X |
| 2,836,039 | 5/1958 | Weber | 62/251 X |
| 3,229,475 | 1/1966 | Balk et al. | 62/246 X |
| 3,730,603 | 5/1973 | Looms | 312/236 X |
| 4,270,819 | 6/1981 | Ooho | 312/116 |
| 4,458,501 | 7/1984 | Kooy | 312/116 X |
| 4,608,776 | 9/1986 | Kooy | 312/116 X |
| 4,608,835 | 9/1986 | Kooy | 62/256 |

FOREIGN PATENT DOCUMENTS

| | | | |
|---|---|---|---|
| B-40037/93 | 12/1993 | Australia | 312/116 |
| 285770 | 11/1989 | Japan | 62/246 |

*Primary Examiner*—Jose V. Chen
*Assistant Examiner*—James O. Hansen
*Attorney, Agent, or Firm*—Zarley McKee, Thomte, Voorhees & Sease

[57] ABSTRACT

A cooled display case includes a housing enclosing a display compartment and having an opening providing access thereinto. An air stratifier panel divides the display compartment into an upper air well above the stratifier panel and a lower air well below the stratifier panel. The stratifier panel has a plurality of product holders capable of holding the products with the upper ends thereof above the stratifier panel in the upper air well. The stratifier panel also has air vents adjacent its edge for permitting cooled air to flow from the upper to lower air wells. An air recirculation passageway in the housing has an inlet in the lower air well of the display compartment and an outlet in the upper air well. A coil cools air passing through the passageway. A fan circulates the cooled air through the passageway and into the upper air well of the display compartment.

4 Claims, 5 Drawing Sheets

COOLED DISPLAY CASE

This is a continuation of application Ser. No. 08/642,566 filed on May 3, 1996, now abandoned.

BACKGROUND OF THE INVENTION

The present invention relates to display cases. More particularly, this invention relates to a method and means for cooling products displayed in such cases. This invention is useful in keeping plants or other products, including but not limited to flowers, cool while displaying them.

Existing cooled display cases for products such as plants, flowers and the like typically have a single display chamber through which cool air circulates. Vases or similar containers hold the upper ends of a plurality of products up for display. The bottoms of the vases rest on the bottom of the single chamber or on shelves extending partially across the single chamber. One shortcoming of this arrangement is that the cool air circulating in the single chamber tends to fall around the lower portion of the vase rather than be held near the upper ends of the flowers where the cool air is needed most.

Therefore a primary object of the present invention is the provision of an improved means and method for cooling a display case.

A further object of this invention is the provision of a cooled display case having a stratifier panel extending across the display compartment so as to form an upper air well into which the upper ends of the product extend and a lower air well into which the lower end of the product and vase extend.

A further object of this invention is the provision of a cooled display case wherein air vents extend through and/or around the front of the stratifier panel for venting the cool air from the upper air well to the lower air well and returning the air to the cooling coil.

A further object of this invention is the provision of a cooled display case wherein the stratifier panel can be flat, sloped, or even stepped so as to include a series of downward steps such that the cool air cascades downwardly from an overhead outlet to the air vents at the front of the stratifier panel.

A further object of this invention is the provision of a cooled display case which is simple in construction, economical and durable in use.

These and other objects will be apparent to one skilled in the art from the drawings, description, and claims which follow.

SUMMARY OF THE INVENTION

The present invention achieves the above objects by providing a cooled display case for displaying a plurality of products, including but not limited to plants, flowers and greenery. The cooled display case includes a housing enclosing a display compartment and having an opening providing access thereinto. The display compartment has an upper portion, a lower portion, a front portion, and a rear portion. An air stratifier panel divides the display compartment into an upper air well above the stratifier panel and a lower air well below the stratifier panel. The stratifier panel has a plurality of product holders capable of holding the products with the upper ends thereof above the stratifier panel in the upper air well. The stratifier panel also has air vents extending therethrough and/or therearound to provide a first air circulation passageway between the upper and lower air wells.

A second air circulation passageway in the housing has an inlet in the lower air well of the display compartment and an outlet in the upper air well. A coil cools air passing through this passageway. A fan circulates the cooled air through the second passageway and into the upper air well of the display compartment.

The stratifier panel of the present invention slows the descent of the cool air and encourages it to fall toward the air vents. By restricting the passage of cooled air from the upper well to the lower well, better cooling is provided. In one embodiment in which the panel is sloped and comprises a plurality of descending steps, the cooled air cascades downwardly and forwardly to effectively cool the products, especially the upper ends thereof.

DETAILED DESCRIPTION OF THE PREFERRED EMBODIMENT

Figure 1:
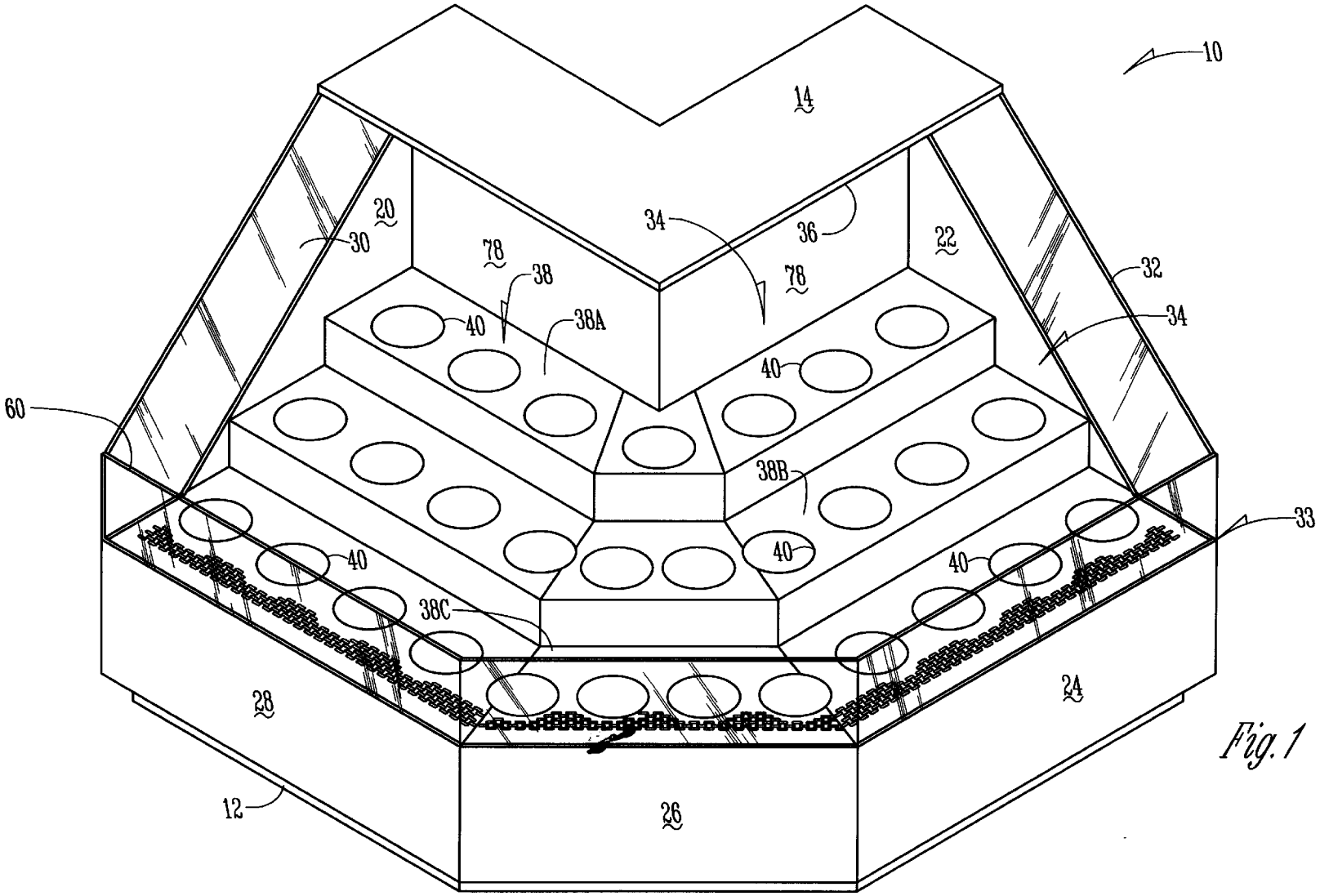
FIG. 1 is a perspective view of the cooled display case of the present invention.

In the drawings and the description which follows, the cooled display case of the present invention is designated with reference numeral 10. Referring to FIG. 1, the cooled display case 10 has a generally inverted V-shape, but can have an infinite variety of shapes and configurations. Such a configuration is particularly useful when setting up a display in the corner of a room or display area.

Figure 3:
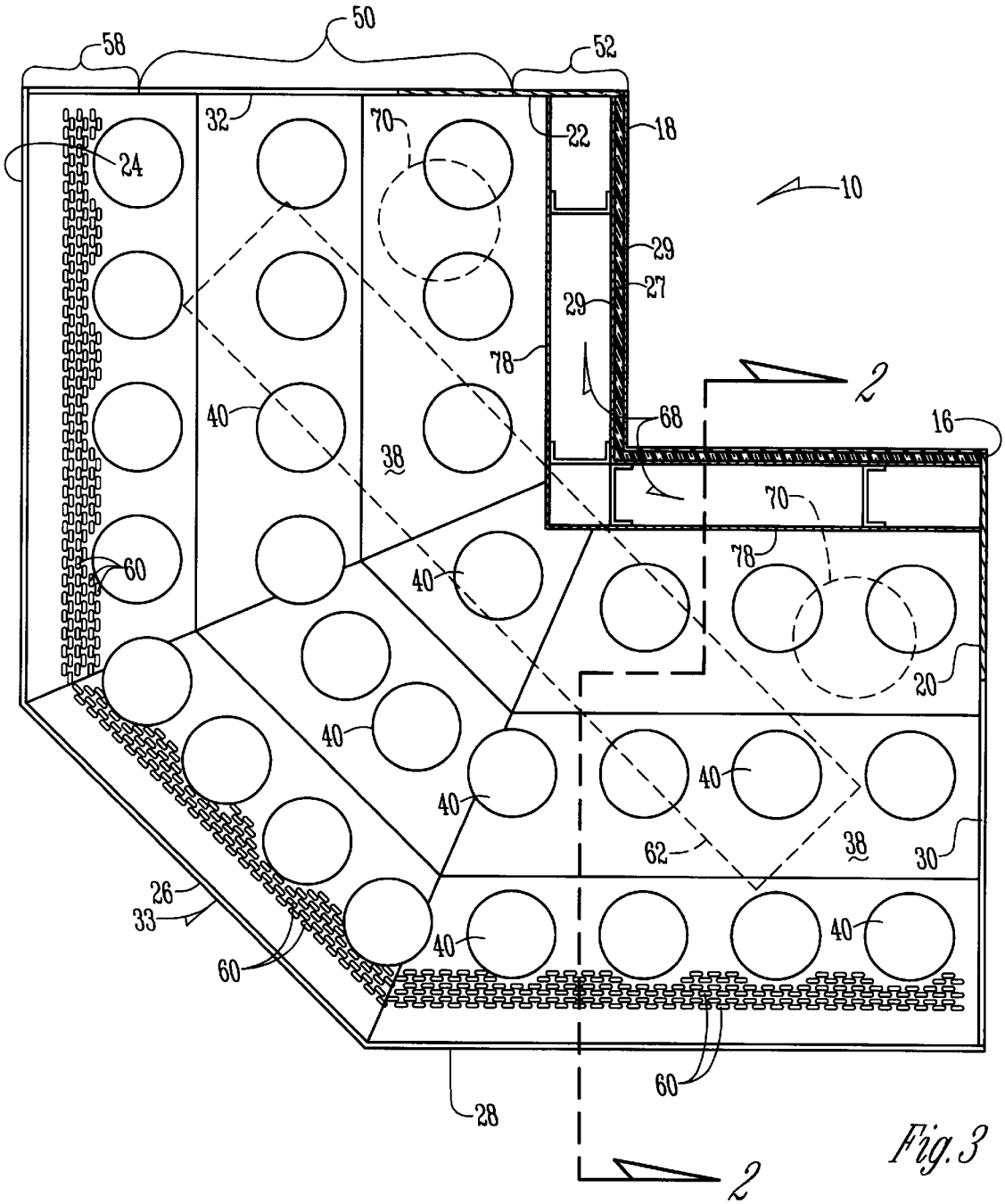
FIG. 3 is a horizontal cross-sectional view taken along line 3—3 in FIG. 2 and shows the display case of this invention with the products removed.

The cooled display case 10 includes a bottom 12, a top 14 and a plurality of generally vertical sides 16–28 (see FIG. 3). The back sides 16 and 18 are joined to each other at approximately a right angle. The end sides 20, 22 are attached at right angles to the back sides 16, 18 respectively and extend forward therefrom. The front sides 24, 26, 28 are shorter than the back sides 16, 18 to allow a passerby to easily view inside the display case 10.

Figure 2:
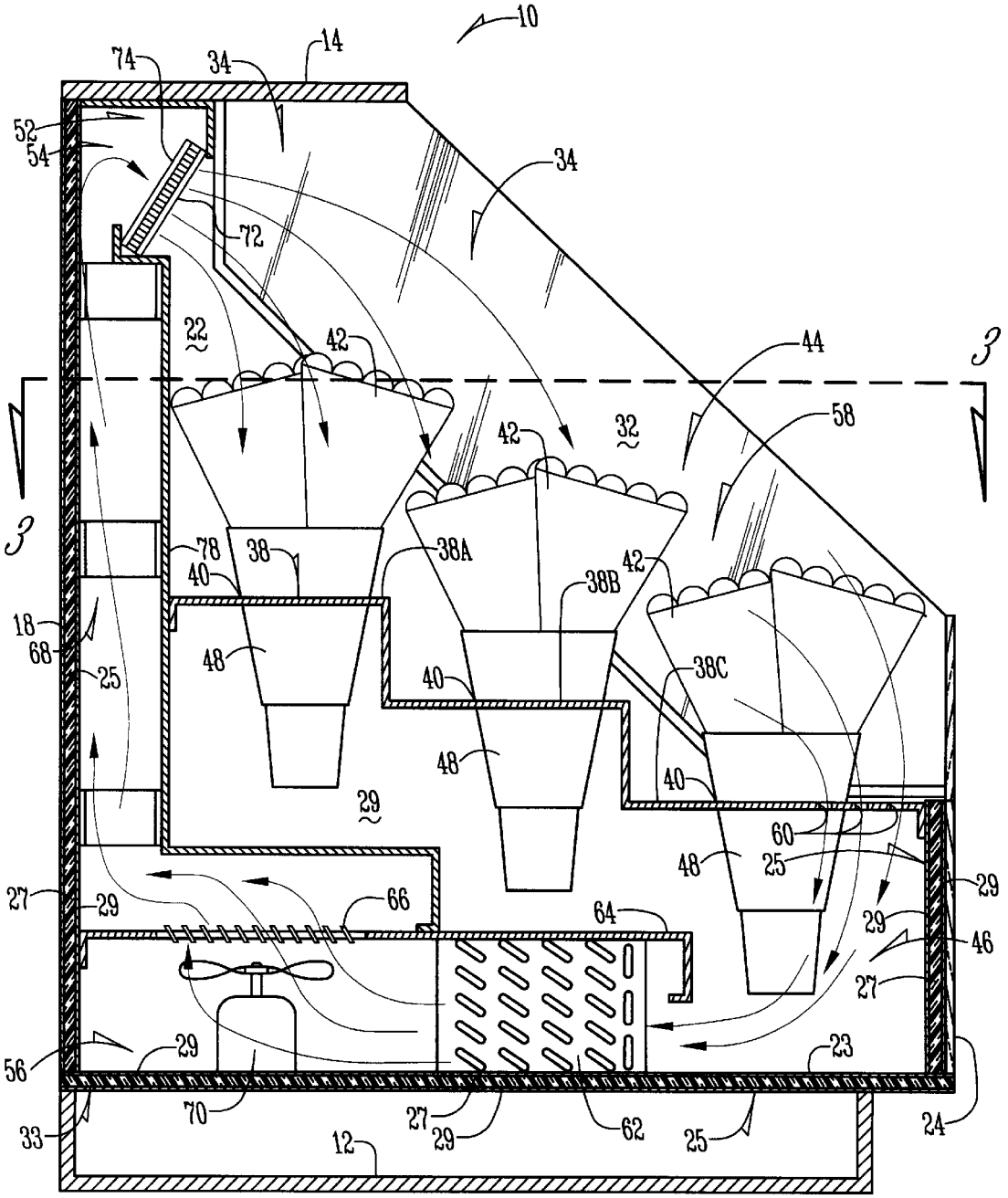
FIG. 2 is a vertical cross-sectional view of the display case of this invention taken along line 2—2 in FIG. 3 (flowers have been added to exemplify the positioning of products within the display case).

As best seen in FIG. 3, end side 20 connects the left back side 16 with the front left side 28. Similarly, the end side 22 connects the back right side 18 with the front right side 24. Therefore, the sides 20, 22 can also be referred to as connecting sides. A front center side 26 connects the front right side 24 with the front left side 28. Referring to FIG. 1, the upper portion of each of the front sides 24, 26, 28 is constructed of clear glass, plexiglass, or similar transparent material to enhance the visibility into the display case 10. As seen in FIG. 2, the back sides 16, 18, the base panel 23, and the lower portion of each of the front sides 24, 26, 28 and each of the end or connecting sides 20, 22, comprises an insulative panel 25 having a layer of insulation 27 sandwiched between two spaced apart sheet metal skins 29. Suitable decorative material, such as opaque glass can be affixed to the outer skin 29. A single sheet of glass can be used on each side 24, 26, 28, with the upper portion being clear and the bottom portion being opaque or even mirrored.

Likewise, connecting sides 20 and 22 include glass, plexiglass, or other suitably transparent panels 30 and 32 respectively. The panels 30, 32 extend from the top 14 to the front left side 28 or the front right side 24, respectively, as shown in FIG. 1. The glass panels 30, 32 also form the final portions of the housing 33 or enclosure for the cooled display case 10 and define an opening 36 therein which provides access to the display compartment 34 from outside the housing.

An air stratifier panel 38 extends from the rear portion of the display compartment 34 to the front sides 24, 26, 28 at the front portion of the display compartment 34. The air stratifier panel 38 effectively slopes downwardly from the rear portion of the display compartment 34 to the front portion of the display compartment 34. There are many ways for the panel 38 to effectively slope downwardly. As best seen in FIG. 2, the air stratifier panel 38 preferably comprises a series of descending steps or sub panels 38A, 38B, 38C. The panel 38 includes a plurality of product holders or holes 40 therein for holding a product 42, including but not limited to flowers, plants, or greenery. The air stratifier panel 38 divides the display compartment 34 into upper and lower air wells 44, 46, respectively. The upper air well 44 is located above the panel 38 and the lower air well 46 is located below the stratifier panel 38.

The products 42 each have an upper end that extends above the stratifier panel 38 into the upper air well 44 and a lower end that extends below the stratifier panel 38 into the lower air well 46. A tapered vase 48 or other suitable containing structure is provided to hold the lower ends of the products 42. The vase 48 fits into or rests in the product holders 40 so as to position the upper and lower ends in the air wells 44, 46 as previously discussed.

As can be appreciated from FIGS. 2 and 3, the display case housing 33 includes front, rear, top and bottom portions 50, 52, 54, 56, respectively. The air stratifier panel 38 and the products 42 are essentially disposed in a central portion 58 of the housing. The air stratifier panel 38 includes a plurality of air vents 60 therethrough at the front portion 50 of the housing 33. As best seen in FIG. 3, the air vents 60 are preferably a plurality of perforations which extend through the panel 38. The provision of the air vents 60 near the lowermost and foremost part of the panel 38 (i.e.—at the front of the subpanel 38C) improves the air flow through the display compartment 34. The size and number of the air vents 60 can be selected to provide the desired air flow and cooling characteristics. At least some of the air vents 60 should be positioned in front of the foremost product holder 40 to insure the flow of cooling air across the foremost products 42.

A cooling coil 62 is mounted below the air stratifier panel 38 in the bottom portion 56 of the housing 33. The cooling coil 62 is preferably a 5 X 53-9 R-12/60 SRC standard refrigeration coil. As seen in FIG. 2, the coil 62 communicates with the lower air well 46, but such communication is limited primarily to the front portion of the lower air well 46 due to a horizontally disposed ledge 64 which extends from the back sides 16, 18 of the display case 10. The ledge 64 includes an air intake opening 66 therein downstream from the coil 62. A plenum 68 is in communication with the air intake opening 66 and extends thereabove in the rear portion 52 of the housing 33. A fan 70 mounts in the bottom portion 56 of the housing 33 and draws air from the upper and lower air wells 44, 46 through the cooling coil 62, and forces the cooled air through the air intake opening 66 and up the plenum 68 to the top portion 54 of the housing 33. The upper end of the plenum 68 includes an outlet 72 which has a honeycombed diffusing grate 74 mounted thereacross. The diffusing grate 74 directs and diffuses the cooled air so as to prevent it from blowing too forcefully upon the products 42 below.

Although it is preferred that the fan 70 be located downstream from the cooling coil 62, the fan 70 could also be located upstream of the coil 62 and force air therethrough without seriously detracting from the present invention. The fan 70 and/or the coil 62 can also be located in the top portion 54 or the central portion 58 of the housing 33 so long as a good circuitous flow of air is provided. As seen in FIG. 3, it has been found that two fans 70 can be placed as shown and supply cooled air through two plenums 68 to more effectively cool larger, deep well display cases 10.

Referring again to FIG. 2, the inside wall 78 of the plenum 68, the ledge 64, the sides 16–28 and the panels 30, 32 of the housing 33 define a display compartment 34 within the display case 10. An upper air well 44 is defined above the air stratifier panel 38. A lower air well 46 is defined by the inside wall 78 of the plenum 68, the ledge 64, the base panel 23 of the housing 33, the air stratifier panel 38 and the other sides 20, 22, 24, 26, 28 of the housing 33 (see FIG. 3 as well). The lower air well 46 should be dimensioned so as to provide adequate air flow around the bottom of the vases 48.

In operation, the fan 70 draws air from the lower air well 46 (from the upper air well 44 through the air vents 60) through the cooling coil 62. The cooled air from the cooling coil is then displaced upwardly by the fan 70 through the intake opening 66 of the plenum 68. When the cooled air reaches the top of the plenum 68, it is forced through the diffusing grate 74 and dispersed into the upper air well 44 over the upper ends of the products 42. The cooled air cascades down the sloped or stepped air stratifier panel 38 and eventually escapes through the air vents 60 into the lower air well 46. Thereafter, the cycle is repeated as necessary to maintain the desired cooling effect. Suitable conventional valve means control the operation of the cooling coil 62 and the fan 70 to achieve the desired cooling effect.

Figure 4:
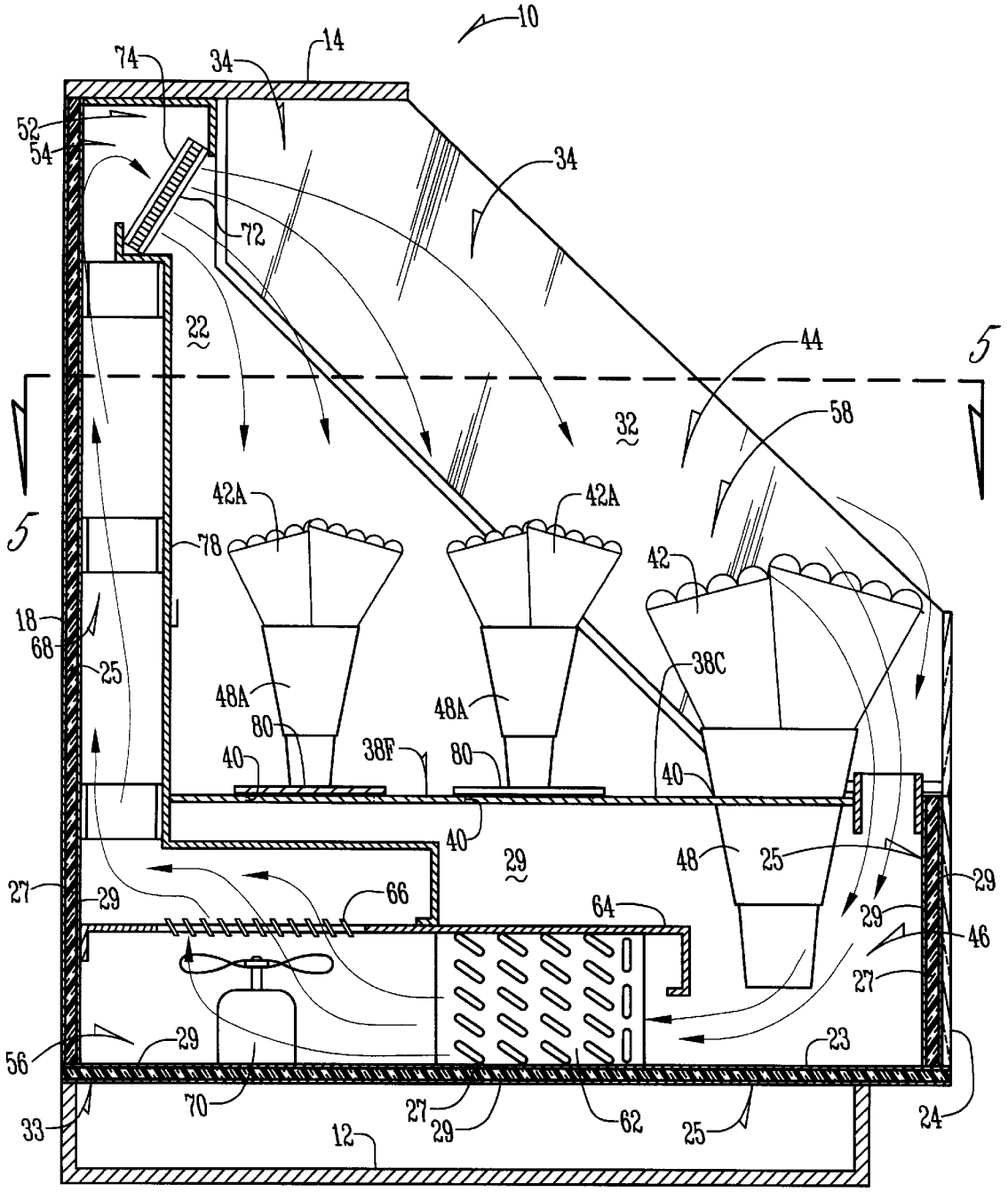
FIG. 4 is a vertical cross-sectional view of another embodiment of this invention taken along line 4—4 in FIG. 5 (flowers have been added to exemplify the positioning of products within the display case).
Figure 5:
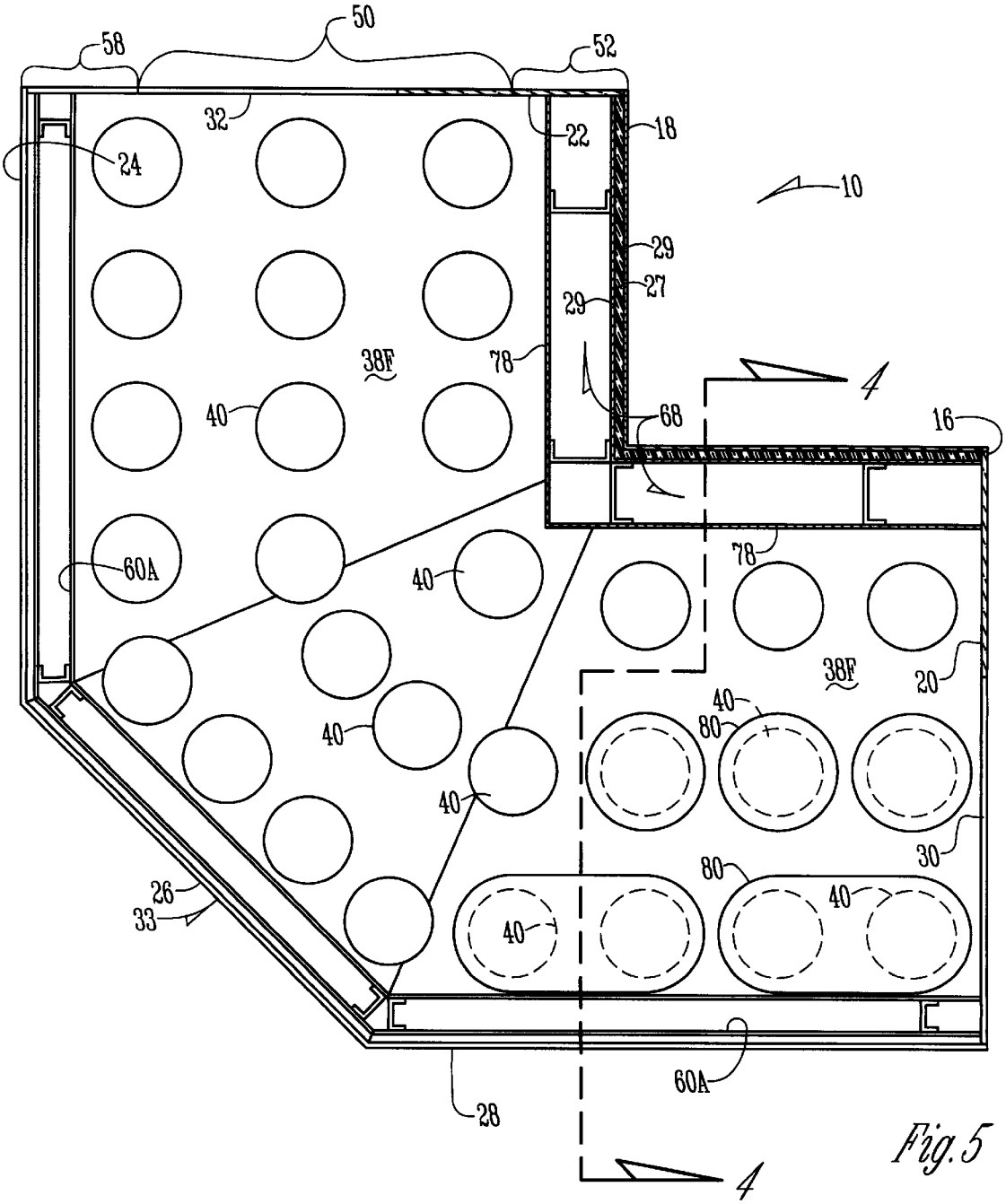
FIG. 5 is a horizontal cross-sectional view taken along line 5—5 in FIG. 4 and shows the display case with the products removed.

FIGS. 4 and 5 show an alternate embodiment of this invention wherein the air stratifier panel 38F is disposed horizontally and is substantially flat. Also shown is an alternative way of providing return air vents or ducts that allow the cooled air to move from the upper air well 44 to the lower air well 46 notwithstanding the stratifier panel 38F. An air circulation passageway 60A includes a horizontally elongated vent slot or plenum which extends adjacent the perimetric edge of the stratifier panel 38F and between the upper and lower air wells 44, 46.

FIGS. 4 and 5 also show various configurations of sealing means 80 for covering one or more of the unused holes 40 in the stratifier panel 38F. It is contemplated that one cover 80 of suitable size and dimensions could cover more than one hole or even all of the holes 40 in the display case 10. The covers 80 can also be substantially rigid so as to support products while covering the holes 40. For instance, rigid covers 80 would be advantageous when displaying long stem roses and daisies simultaneously in the same case 10. As shown in FIG. 4, the vase 48A containing daisies 42A could be placed on a cover 80 and the vase 48 containing roses 42 could be inserted into a hole 40. To ensure that the cooling advantages of this invention are realized, the covers 80 should have a low profile or height above the stratifier panel 38F.

The present invention provides better air flow and thus more uniform cooling for the upper ends of the products 42 than has been possible heretofore. Delicate, expensive products such as flowers can be cooled effectively. The upper ends or blooming portions of the flowers are provided with a cascading blanket of cool air. Therefore, it can be seen that the present invention at least accomplishes its stated objectives.

It will be appreciated that the present invention can take many forms and embodiments. The true essence and spirit of this invention are defined in the appended claims, and it is not intended that the embodiment of the invention presented herein should limit the scope thereof.

What is claimed is:

1. A cooled display case comprising:

a plurality of products to be displayed;

a housing comprising a front wall, a back wall, a bottom wall and end walls forming a display compartment, said housing having an access opening providing access to said display compartment from outside said housing;

an air stratifier panel within said display compartment and dividing said display compartment into an upper air well above said stratifier panel and lower air well below said stratifier panel;

an air passageway having an inlet opening below said air stratifier panel, and outlet opening above said air stratifier panel and passageway walls enclosing said passageway between said inlet opening and said outlet opening;

said stratifier panel having at least one air vent therein for permitting air to pass from said upper air well to said lower air well;

said stratifier panel having a plurality of holder receiving holes therein;

a plurality of product holders each having an open upper end receiving said products and a closed lower end;

said product holders each being fitted within one of said holder receiving holes in said stratifier panel, with said open upper ends of said product holders within said upper air well and said lower ends of said product holders within said lower air well;

a cooling coil; and a fan positioned to move air over said cooling coil, through said passageway, and out of said outlet end of said passageway;

said passageway comprising a ledge positioned within said lower air well and a plenum extending from said ledge upwardly into said upper air well, said cooling coil being within said passageway and said product holders being completely outside said passageway.

2. A cooled display case according to claim 1 wherein said cooling coil is positioned adjacent said inlet opening of said passageway.

3. A cooled display case comprising:

a plurality of products to be displayed;

a housing comprising a front wall, a back wall, a bottom wall and end walls forming a display compartment, said housing having an access opening providing access to said display compartment from outside said housing;

an air stratifier panel within said display compartment and dividing said display compartment into an upper air well above said stratifier panel and lower air well below said stratifier panel;

an air passageway having an inlet opening below said air stratifier panel, and outlet opening above said air stratifier panel and passageway walls enclosing said passageway between said inlet opening and said outlet opening;

said stratifier panel having at least one air vent therein for permitting air to pass from said upper air well to said lower air well;

said stratifier panel having a plurality of holder receiving holes therein;

a plurality of product holders each having an open upper end receiving said products and a closed lower end;

said product holders each being fitted within one of said holder receiving holes in said stratifier panel, with said open upper ends of said product holders within said upper air well and said lower ends of said product holders within said lower air well;

a cooling coil; and a fan positioned to move air over said cooling coil, through said passageway, and out of said outlet opening of said passageway;

said stratifier panel including a front edge adjacent said front wall of said housing and extends upwardly and rearwardly therefrom to terminate in a rear edge, whereby said air exiting from said outlet end of said passageway will cascade downwardly and forwardly over said stratifier panel.

4. A cooled display case according to claim 3 wherein said air vent is located adjacent said front edge of said stratifier panel.

* * * * *